US006045456A

United States Patent [19]

Best et al.

[11] Patent Number: 6,045,456

[45] Date of Patent: Apr. 4, 2000

[54] GOLF CLUB WITH IMPROVED WEIGHTING AND VIBRATION DAMPENING

[75] Inventors: Christopher B. Best, Encinitas; William F. Davidson, Laguna Niguel, both of Calif.

[73] Assignee: Cobra Golf Incorporated, Carlsbad, Calif.

[21] Appl. No.: 09/012,712

[22] Filed: Jan. 23, 1998

Related U.S. Application Data

[60] Provisional application No. 60/036,712, Jan. 23, 1997.

[51] Int. Cl.[7] ..... A63B 53/04

[52] U.S. Cl. ..... 473/291; 473/342; 473/332; 473/350

[58] Field of Search ..... 473/324, 290, 473/291, 332, 350, 342, 329, 349

[56] References Cited

U.S. PATENT DOCUMENTS

| | | |
|---|---|---|
| D. 343,435 | 1/1994 | Poincenot et al. . |
| D. 343,665 | 1/1994 | Feche et al. . |
| D. 345,403 | 3/1994 | Sanchez . |
| D. 345,775 | 4/1994 | Poincenot et al. . |
| D. 357,290 | 4/1995 | Viollaz et al. . |
| D. 361,356 | 8/1995 | Feche et al. . |
| D. 361,813 | 8/1995 | Guibaud et al. . |
| D. 365,129 | 12/1995 | Guibaud et al. . |
| D. 371,818 | 7/1996 | Stolz . |
| 700,946 | 5/1902 | Kempshall . |
| 708,575 | 9/1902 | Mules . |
| 819,900 | 5/1906 | Martin . |
| 925,389 | 6/1909 | Royce . |
| 1,359,220 | 11/1920 | Beamer . |
| 1,571,109 | 1/1926 | East . |
| 2,429,351 | 1/1947 | Fetterolf . |
| 2,846,228 | 8/1958 | Reach . |
| 3,695,618 | 10/1972 | Woolley et al. . |
| 3,975,023 | 8/1976 | Inamori . |
| 3,989,248 | 11/1976 | Campau . |
| 4,420,156 | 12/1983 | Campau . |
| 4,681,322 | 7/1987 | Straza et al. . |
| 4,804,188 | 2/1989 | McKee et al. . |
| 4,812,187 | 3/1989 | Honma . |
| 4,848,747 | 7/1989 | Fujimura . |
| 4,884,812 | 12/1989 | Nagasaki et al. . |
| 5,064,197 | 11/1991 | Eddy . |
| 5,083,778 | 1/1992 | Douglass . |
| 5,090,702 | 2/1992 | Viste . |
| 5,171,621 | 12/1992 | Desbiolles et al. . |
| 5,174,573 | 12/1992 | Desbiolles et al. . |
| 5,178,392 | 1/1993 | Santioni . |
| 5,184,823 | 2/1993 | Desbiolles et al. . |
| 5,197,737 | 3/1993 | Desbiolles et al. . |
| 5,275,408 | 1/1994 | Desbiolles et al. . |
| 5,282,624 | 2/1994 | Viste . |
| 5,290,036 | 3/1994 | Fenton et al. . |
| 5,294,119 | 3/1994 | Vincent et al. . |
| 5,299,807 | 4/1994 | Hutin . |

(List continued on next page.)

FOREIGN PATENT DOCUMENTS

| | | |
|---|---|---|
| 2272381 | 5/1994 | United Kingdom . |
| 2 264 440 | 3/1995 | United Kingdom . |
| 2 259 861 | 4/1995 | United Kingdom . |
| 2 260 499 | 4/1995 | United Kingdom . |
| 2 267 650 | 5/1995 | United Kingdom . |
| 2 267 221 | 8/1995 | United Kingdom . |
| 2 268 412 | 8/1995 | United Kingdom . |

*Primary Examiner*—Sebastiano Passaniti
*Attorney, Agent, or Firm*—Pennie & Edmonds LLP

[57] ABSTRACT

A golf clubhead having a cavity back design and a three piece construction. The clubhead body portion includes a strike face insert cavity for receiving a strike face insert and further includes a central aperture. An additional recess is formed within the strike face insert cavity and may receive vibration dampening material. The sizes of the strike face insert cavity, vibration dampening insert recess and aperture may be progressively varied, or varied in other desirable manners in accordance with the particular golf club characteristics, to improve weight distribution and/or vibration dampening and to increase strike face surface area.

20 Claims, 3 Drawing Sheets

U.S. PATENT DOCUMENTS 5,310,185 5/1994 Viollaz et al. .
5,316,299 5/1994 Feche et al. .
5,332,214 7/1994 Tucker, Sr. .
5,333,861 8/1994 Mills .
5,342,052 8/1994 Costa .
5,346,213 9/1994 Yamada .
5,346,219 9/1994 Pehoski et al. .
5,354,059 10/1994 Stuff .
5,377,986 1/1995 Viollaz et al. .
5,388,826 2/1995 Sherwood .
5,398,929 3/1995 Kitaichi .
5,403,007 4/1995 Chen .
5,405,136 4/1995 Hardman .
5,405,137 4/1995 Vincent et al. .
5,407,196 4/1995 Busnardo .
5,415,405 5/1995 Vincent .
5,425,535 6/1995 Gee .
5,425,538 6/1995 Vincent et al. .
5,429,358 7/1995 Rigal et al. .
5,431,396 7/1995 Shieh .
5,433,440 7/1995 Lin .
5,439,219 8/1995 Vincent .
5,447,309 9/1995 Vincent .
5,447,311 9/1995 Viollaz et al. .
5,467,984 11/1995 Veux et al. .
5,472,201 12/1995 Aizawa et al. .
5,482,280 1/1996 Yamawaki .
5,484,155 1/1996 Yamawaki et al. .
5,492,327 2/1996 Biafore, Jr. .
5,499,814 3/1996 Lu .
5,505,450 4/1996 Stuff .
5,505,453 4/1996 Mack .
5,529,543 6/1996 Beaumont, Sr. .
5,593,356 1/1997 Takeda .
5,605,511 2/1997 Schmidt et al. .
5,707,302 1/1998 Leon .

GOLF CLUB WITH IMPROVED WEIGHTING AND VIBRATION DAMPENING

CROSS-REFERENCE TO RELATED APPLICATIONS

This application claims the benefit of U.S. Provisional Application No. 60/036,712, filed Jan. 23, 1997.

FIELD OF THE INVENTION

The present invention generally relates to golf clubs and, more particularly, to a golf club having a head with a combination of improved perimeter weighting characteristics, vibration dampening characteristics and increased striking face surface area.

BACKGROUND OF THE INVENTION

The individual golf clubheads in a set typically increase progressively in strike face surface area and weight as the clubs progress from the long irons to the short irons. Therefore, the clubheads of the long irons have a smaller strike face surface area than the short irons and are typically more difficult for the average golfer to hit consistently well. For conventional clubheads, this arises at least in part due to the smaller sweet spot of the corresponding smaller strike face.

To help the average golfer consistently hit the sweet spot of a clubhead, many golf clubs are available having heads with so-called cavity back designs with increased perimeter weighting. Another more recent trend has been to simply increase the overall size of the clubheads, especially in the long irons. Each of these features will increase the size of the sweet spot and therefore make it more likely that a shot hit slightly off the center of gravity of the clubhead still makes contact with the sweet spot and flies farther and straighter as a result. One challenge for the golf club designer when maximizing the size of the clubhead concerns maintaining a desirable and effective overall weight of the golf club. For example, if the clubhead of a three iron is increased in size and weight, the club may become difficult for the average golfer to properly swing.

Another problem area for the average golfer is that of excess vibration resulting from an off center impact with the golf ball. Various types of vibration dampeners have been incorporated into clubheads to absorb these impact vibrations. However, there is still a need for improvement in both the area of weight redistribution and vibration dampening in golf clubheads, and especially oversize iron type clubheads.

SUMMARY OF THE INVENTION

It is therefore one object of the present invention to provide a golf club having a head with improved weight distribution and increased strike face surface area.

A further object of the invention is to provide improved weight distribution progressively throughout a set of iron type clubheads, such as oversized clubheads.

Another object of the invention is to improve the vibration dampening characteristics at impact of the strike face and the ball.

These and other objects and advantages of the present invention are embodied in a golf club and, more particularly, an iron type golf club having a head formed with at least two distinct pieces. One piece forms the body of the clubhead and another piece forms the strike face of the clubhead. The strike face is insertable into a strike face insert cavity at the front of the clubhead body. A front surface of the strike face insert cavity further includes a recess, which allows redistribution of weight to the perimeter of the clubhead, and additionally may contain vibration dampening material. The club head body, preferably, has a rear cavity having an aperture therethrough and adjacent to the rear portion of the strike face insert. The rear cavity and/or aperture also allow redistribution of weight to the perimeter of the clubhead.

Redistribution of weight to the perimeter of the clubhead provides a larger strike face surface area. Additionally, in preferred embodiments, the size of the recess, strike face insert cavity, rear cavity, and aperture are varied from club to club to achieve improved weight distribution throughout a set of clubs while maximizing the strike face surface area of each club and providing greater vibration dampening in the longer clubs, where it is most needed. These features and advantages of the invention as well as others will become more readily apparent to the skilled artisan upon review of the following detailed description of the invention taken in conjunction with the accompanying drawings.

DETAILED DESCRIPTION OF THE PREFERRED EMBODIMENTS

Figure 1:
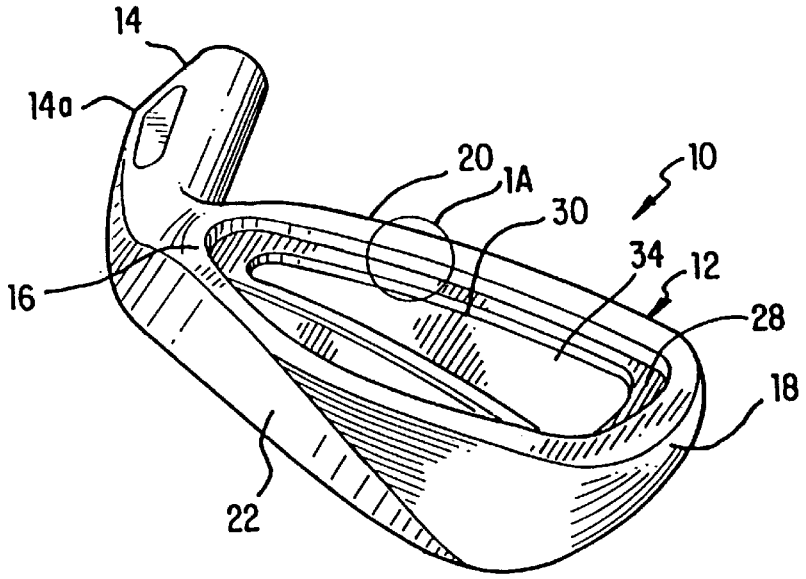
FIG. 1 is a rear perspective view of an iron type golf clubhead of the present invention showing the aperture and the strike face insert rigidly affixed to the clubhead and abutted against the aperture.
Figure 1A:
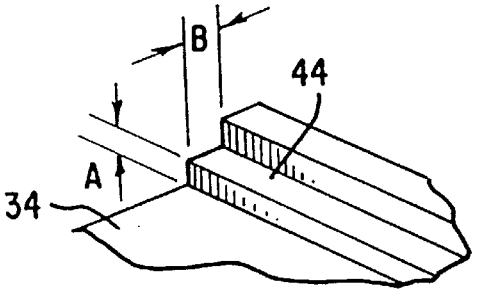
FIG. 1A is an exploded perspective of the rear cavity area as indicated by circle 1A in FIG. 1.
Figure 2:
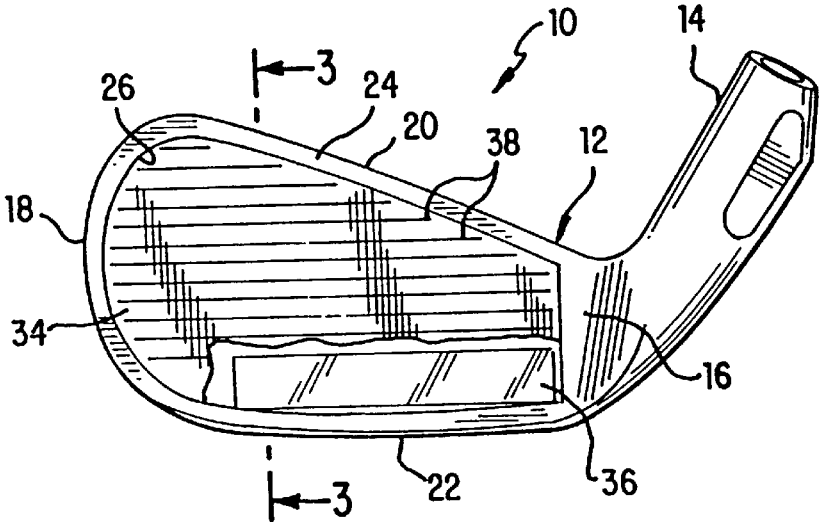
FIG. 2 is a front elevational view of the clubhead including the clubhead body portion and strike face insert and partially fragmented to show a vibration dampening insert.
Figure 3:
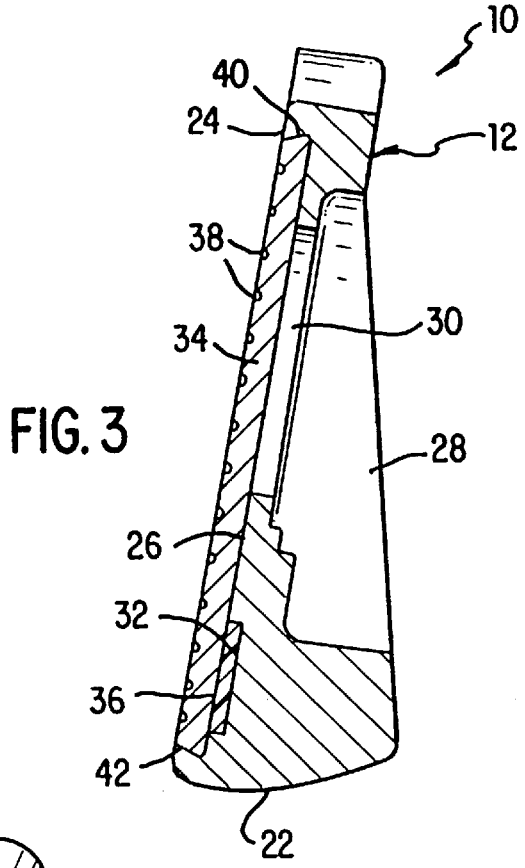
FIG. 3 is a cross sectional view taken along line 3—3 of FIG. 2 showing the clubhead body portion, strike face insert, aperture, rear cavity and vibration dampening insert in place.
Figure 4:
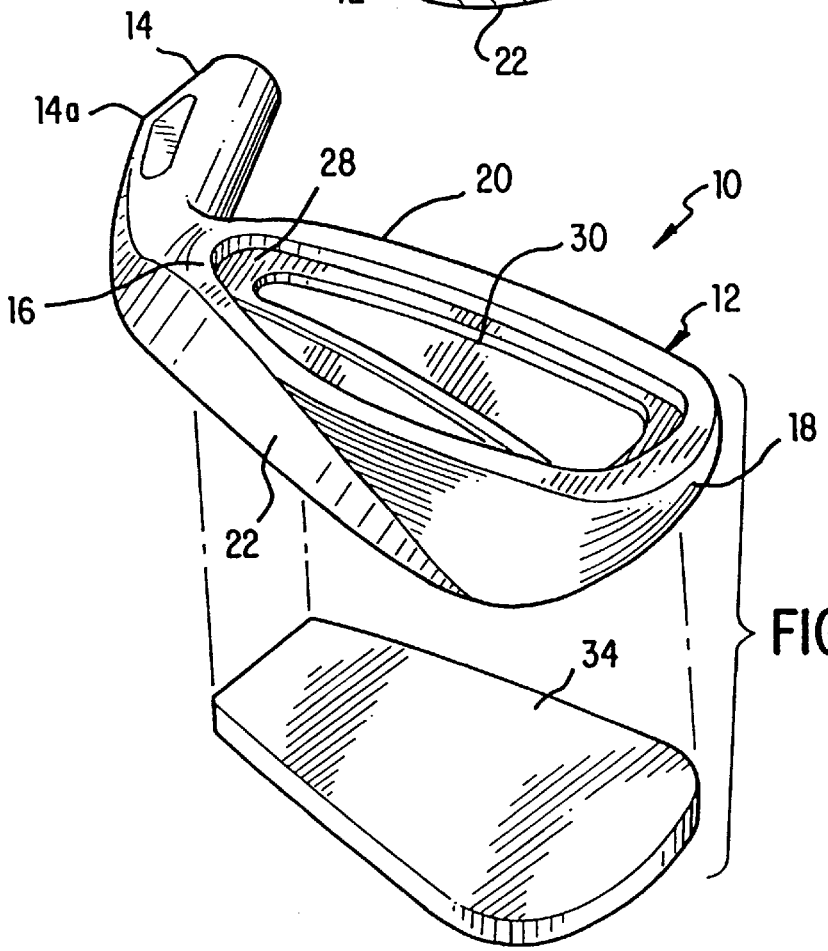
FIG. 4 is an exploded perspective view of the clubhead body portion and strike face insert.

Referring first to FIG. 1, clubhead 10 constructed in accordance with a preferred embodiment of this invention is shown and includes generally clubhead body portion 12 having hosel portion 14, heel portion 16, toe portion 18, upper edge 20 and lower edge 22. As shown best in FIGS. 2, 3 and 5, clubhead body portion 12 includes front side 24 with strike face insert cavity 26 contained therein. Recess 32, as shown in FIG. 3, extends longitudinally across substantially the entire lower front portion of strike face insert cavity 26. Clubhead body portion 12 further includes rear cavity 28 and aperture 30 extending generally longitudinally across an upper area of clubhead body portion 12. Shelf 44, shown best in FIG. 1A, surrounds aperture 30 and is defined by depth A and width B.

Figure 5:
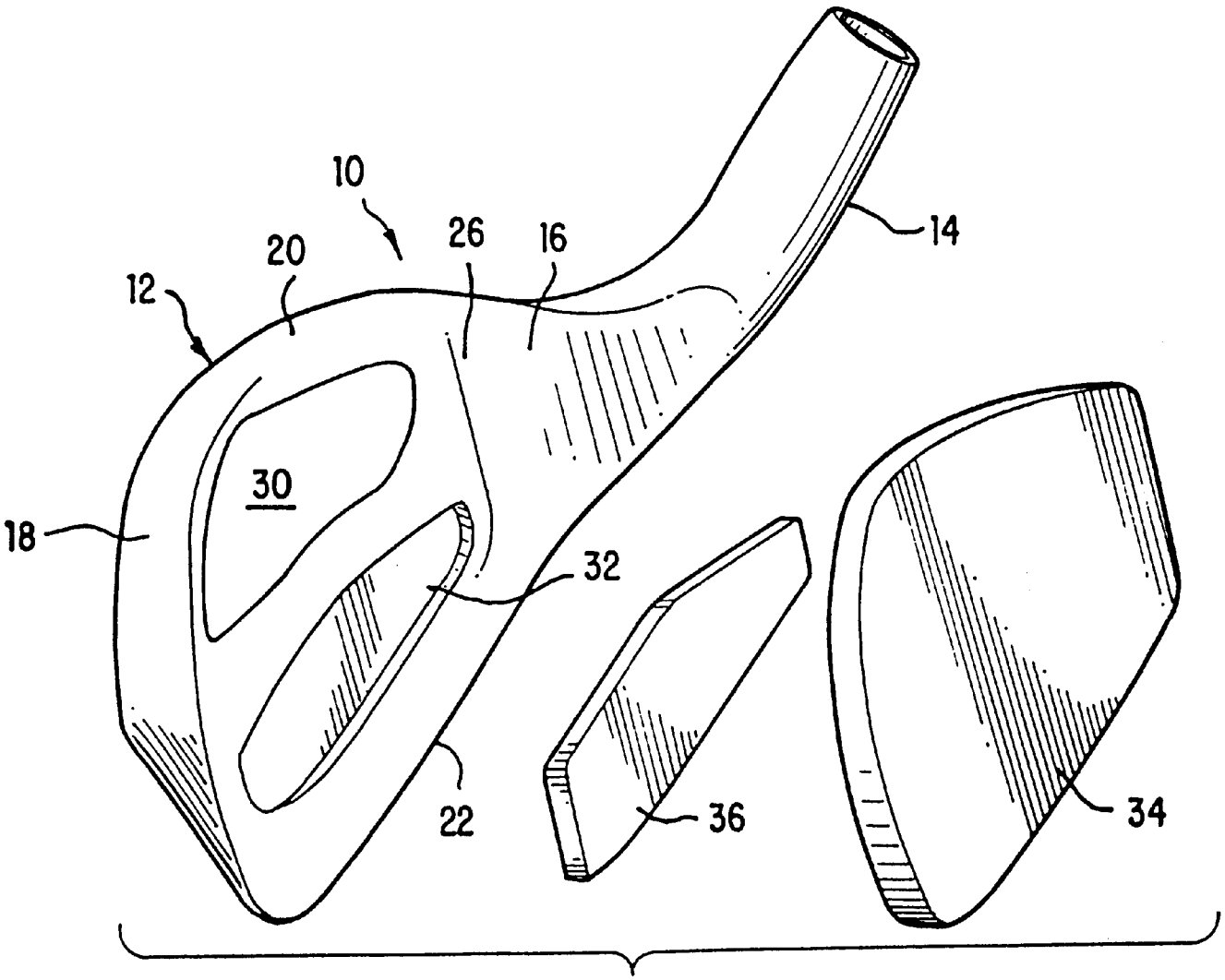
FIG. 5 is an exploded perspective view of a three piece clubhead of the present invention having an alternatively shaped vibration dampening insert.

Recess 32 preferably serves as a vibration dampening insert cavity for receiving vibration dampening insert 36, formed of resilient polymeric material such as "Scotchdamp" from 3M in Minneapolis, Minn. or "Sorbothane" from Sorbothane Inc., in Kent, Ohio. Alternative shapes for insert 36 are shown in FIGS. 2 and 5. The skilled artisan will readily recognize that many different shock absorbing materials having many different shapes and sizes may be substituted without deviating from the scope of the invention.

Recess 32 may also be left void of any material. Recess 32 also serves as a further means of redistributing weight to the perimeter portions, i.e., hosel portion 14, heel 16, toe 18, upper edge 20 or lower edge 22 of clubhead body 12.

Strike face insert 34 is preferably made from titanium although the skilled artisan will recognize that other suitable materials, having sufficient strength characteristics and a strength to weight ratio greater than that of the material of club head body, may be substituted without deviating from the scope of the invention. Some examples are graphite, Kevlar®, ceramics, beryllium alloys and the like. Strike face insert 34 is preferably coldworked into strike face insert cavity 26 and includes conventional grooves 38 on a front surface thereof. Undercuts 40, 42 may be provided along the peripheral edge of strike face insert cavity 26 for holding strike face insert 34, as shown in FIG. 3.

In accordance with the present invention, it will be appreciated that various aspects of the invention, as well as combinations thereof provide a golf club with an improved manner of redistributing weight from central portions of the golf club to perimeter portions of the clubhead, thereby increasing the face area and sweet spot without detrimentally altering overall weight or handling characteristics of the club. Aperture 30 and recess 32 eliminate material from a center portion of the head allowing redistribution toward the perimeter. Additionally, the volume of shelf 44 may be adjusted to redistribute material from more central locations of the clubhead to more peripheral locations. The volume of shelf 44 is approximately equal to A×B×(the perimeter of aperture 30). Strike face insert cavity 26 may also be varied in depth and replaced by a lighter strike face insert material as previously explained, thus allowing redistribution of excess weight.

The size of each of these features of the invention may be varied throughout a set of clubheads, depending on the particular characteristics of the clubhead. In a preferred embodiment, the area of strike face insert 34 will increase more gradually than with conventional clubheads when moving from long to short irons while overall club weight remains essentially constant. Also, for example, for the long irons that are more difficult for the average golfer to consistently hit well, vibration dampening recess 32 may be larger allowing for a larger vibration dampening insert 36 and redistribution of the excess weight about the perimeter of the strike face area. The use of larger vibration dampening insert 36 provides more vibration dampening for the longer irons where it tends to be needed the most.

In one embodiment, recess 32 is progressively smaller from the long clubs to the short clubs and different for each club. This embodiment allows for optimizing the weight distribution and strike face area for each club. However, manufacturing this embodiment requires a different tool for each club, thus potentially increasing production costs and manufacturing complexities. Therefore, in an alternative embodiment, a two step progression is used for the size of recess 32 to address such concerns while maintaining a sufficiently high degree of performance. In this alternative embodiment, a relatively shallow recess 32 and thin vibration dampening insert 36 may used on iron type clubheads numbered six and higher and a larger recess 32, such as a recess that is twice as deep, may be used on iron type clubheads numbered five and lower. With respect to the volume of strike face cavity 26, recess 32 and the area of aperture 30, more incremental progression throughout the set of clubheads may be used as well. Finally, the material for the vibration dampening insert may be varied, such as by varying the density thereof, to adjust the final club weight and/or vibration dampening characteristics throughout the set of golf clubs. It will be appreciated that a progression of any number of steps, for example every other club rather than every club or only a single step, may be employed in a set of clubs.

The following tables compare a conventional "King Cobra I" set of iron type clubheads with a set of clubheads constructed in accordance with a preferred embodiment of this invention:

"KING COBRA I" CLUBHEAD SET

| HEAD # | WEIGHT (g) | FACE AREA ($IN^2$) |
|---|---|---|
| 3 | 244 | 5.16 |
| 4 | 251 | 5.15 |
| 5 | 258 | 5.27 |
| 6 | 265 | 5.40 |
| 7 | 272 | 5.44 |
| 8 | 279 | 5.63 |
| 9 | 286 | 5.65 |
| P | 286 | 5.79 |
| G | 296 | 6.21 |
| S | 296 | 6.08 |

CLUBHEAD SET OF A PREFERRED EMBODIMENT

| HEAD # | LOFT DEG. | LIE. DEG. | FACE AREA $IN^2$ | VERT AREA $IN^2$ | HOR. AREA $IN^2$ | APER AREA $IN^2$ | APER. DPTH. IN | SHELF 44 VOL/WT ($IN^3$)/g | HEAD WGHT (g) | RECESS 32 VOL/WT ($IN^3$)/g |
|---|---|---|---|---|---|---|---|---|---|---|
| 3 | 22 | 60.0 | 5.69 | 5.28 | 2.13 | 1.20 | 02.094 | .081/10 | 244 | .08/11 |
| 4 | 25 | 60.5 | 5.73 | 5.19 | 2.42 | 1.23 | 0.104 | .091/12 | 251 | .08/11 |
| 5 | 28 | 61.0 | 5.82 | 5.16 | 2.74 | 1.23 | 0.111 | .096/12 | 258 | .08/11 |
| 6 | 32 | 61.5 | 5.85 | 4.93 | 3.08 | 1.26 | 0.117 | .102/13 | 265 | .04/5.5 |
| 7 | 36 | 62.0 | 6.04 | 4.88 | 3.55 | 1.35 | 0.120 | .104/13 | 272 | .04/5.5 |
| 8 | 40 | 62.0 | 6.28 | 4.80 | 4.03 | 1.37 | 0.122 | .107/14 | 279 | .04/5.5 |
| 9 | 44 | 63.0 | 6.17 | 4.43 | 4.28 | 1.34 | 0.123 | .108/14 | 286 | .04/5.5 |
| PW | 48 | 63.5 | 6.34 | 4.24 | 4.71 | 1.37 | 0.125 | .108/14 | 286 | .04/5.5 |
| GW | 53 | 64.0 | 6.53 | 3.93 | 5.21 | 1.16 | 0.123 | .104/13 | 296 | .04/5.5 |
| SW | 56 | 64.0 | 6.63 | 3.61 | 5.54 | 1.31 | 0.112 | .093/12 | 296 | .04/5.5 |
| LH | 56 | 64.0 | 6.64 | 3.32 | 5.75 | 1.11 | 0.104 | .085/11 | 296 | .04/5.5 |

VERT. AREA—The vertical projection of the face (what the ball "sees")

HORIZ. AREA—The horizontal projection of the face (what the player "sees")

APER. AREA—The area of the strike face insert visible through the aperture.

SHELF VOLUME/WEIGHT—The volume/weight of the shelf in the back cavity.

RECESS 32 VOLUME/WEIGHT—The volume of and weight removed from recess 32.

APER. DPTH. Aperture Depth-depicted by dimension A in FIG. 1A

The foregoing description of the preferred embodiments and aspects of this invention is illustrative only. The skilled artisan will readily recognize further modifications and substitutions still falling within the spirit and scope of the invention.

What is claimed is:

1. A golf club with improved weight distribution, the golf club comprising:

a shaft;

a head including a body portion having a front cavity and a rear cavity with an aperture extending through said body portion and communicating with said cavities;

a strike face insert attached within said front cavity, wherein said body portion further defines a recess disposed within said front cavity below the aperture, where said recess extends longitudinally across substantially the entire lower front portion of said front cavity.

2. The golf club of claim 1 wherein said recess in said front cavity is for eliminating weight generally from central portions of the clubhead.

3. The golf club of claim 2 wherein the recess contains a vibration dampening material.

4. The golf club of claim 1, wherein said club is one club in a set of similarly constructed clubs and wherein the strike face insert is progressively larger throughout the set.

5. A golf club with improved weight distribution, the golf club comprising:

a shaft;

a head having a front portion and a back portion;

a front cavity formed within said front portion;

an aperture through said back portion communicating with said front cavity;

a strike face insert attached within said front cavity;

wherein said head further defines a recess disposed within said front cavity below the aperture, where said recess extends longitudinally across substantially the entire lower front portion of said front cavity.

6. The golf club of claim 5 further comprising a recess formed within a central region of the front portion which eliminates material and weight generally from said central region the head.

7. The golf club of claim 6 further comprising a back cavity formed within said back portion wherein said back cavity surrounds said aperture.

8. The golf club of claim 7, wherein the body portion is made from a first material and the strike face insert is made from a second material having a strength to weight ratio greater than said first material.

9. The golf club of claim 7, wherein:

said club forms one club of a set of long to short iron-type golf clubs;

said aperture has a depth and is surrounded by an area having a predetermined width to define a shelf surrounding said aperture; and said shelf encompasses a volume of material, said volume progressively increasing from long irons to short irons in said set.

10. The golf club of claim 9, included in said set of iron-type golf clubs, wherein:

the set includes 3 through 9 irons;

each strike face insert has a progressively larger surface area in said irons from the 3 iron to the 9 iron; and the volume of said recess has a first value for the 3 through 5 irons and a second smaller value for the 6 through 9 irons.

11. The golf club of claim 6, wherein the recess contains a vibration dampening material.

12. The golf club of claim 6, wherein:

said club forms one club of a set of long to short iron-type golf clubs; and the recess has a volume that decreases from long irons to short irons in said set.

13. A golf club of the iron-type with improved weight distribution, the golf club comprising:

a shaft; and a head having a body, a strike face insert and a vibration dampening material;

wherein said body has a front portion and a back portion, said front portion having a first cavity and a second cavity formed therein, with said strike face insert positioned in said first cavity and said vibration dampening material positioned within said second cavity;

wherein said back portion has a third cavity with an aperture disposed therethrough such that said aperture is adjacent to a rear surface of the strike face insert; and wherein the body is made from a first material and the strike face insert is made from a second material having a strength to weight ratio greater than said first material.

14. A set of golf clubs, comprising a plurality of clubs wherein each club comprises a shaft and a clubhead, the shaft of each club being shorter in length than the shaft of a preceding club in said set, wherein:

each clubhead has a front portion and a back portion;

the front portion defines a front cavity and a recess formed within each said front cavity for eliminating weight generally from a central portion of each clubhead of said plurality of clubs;

the back portion defines and surrounds a back cavity with an aperture therein communicating with said front cavity;

a shelf surrounding the aperture, said shelf having a volume which increases corresponding to a decrease in club length for at least some of the clubs in said set; and a strike face insert attached within each said front cavity.

15. The set of golf clubs as claimed in claim 14, wherein the volume of the recess progressively decreases from clubs having a longer length to clubs having a shorter length.

16. The set of golf clubs as claimed in claim 15 wherein each recess contains a vibration dampening material.

17. The set of golf clubs as claimed in claim 16, comprising 3 through 9 irons, wherein:

said strike face insert has a progressively larger surface area on at least some of the irons from the 3 iron to the 9 iron; and the volume of said recess has one value for the 3–5 irons and a second value for the 6–9 irons.

18. A set of golf clubs, comprising at least a first club and a second club, wherein:

each club comprises a shaft and a clubhead, the first club having a longer shaft and lighter clubhead than the second club;

each clubhead comprises a body with front and rear faces, said front face defining a front cavity receiving a strike face insert therein and said rear face defining a rear cavity communicating via an aperture with said front cavity, wherein each clubhead further defines a recess disposed within said front cavity below the aperture, where said recess extends longitudinally across substantially the entire lower front portion of said front cavity.

19. The set of clubs according to claim 18, wherein said front face further defines a recess within said front cavity, said recess having a greater volume in said first club than in said second club.

20. The set of clubs according to claim 18, wherein said rear face defines a shelf within said rear cavity, said shelf surrounding said aperture, and said shelf having a lesser volume in said first club than in said second club.

* * * * *